US011566491B1

(12) United States Patent
Little

(10) Patent No.: US 11,566,491 B1
(45) Date of Patent: Jan. 31, 2023

(54) PUMP-ACTIVATED MANUAL WATER WELL

(71) Applicant: Keith Little, Rocky Mount, NC (US)

(72) Inventor: Keith Little, Rocky Mount, NC (US)

( * ) Notice: Subject to any disclaimer, the term of this patent is extended or adjusted under 35 U.S.C. 154(b) by 61 days.

(21) Appl. No.: 17/146,552

(22) Filed: Jan. 12, 2021

(51) Int. Cl.
*E21B 34/16* (2006.01)
*F04B 47/00* (2006.01)
*E21B 34/06* (2006.01)

(52) U.S. Cl.
CPC ..... *E21B 34/16* (2013.01); *E21B 34/06* (2013.01); *F04B 47/00* (2013.01)

(58) Field of Classification Search
CPC ..... E21B 34/06; E21B 34/16; F04B 47/00
See application file for complete search history.

(56) References Cited

U.S. PATENT DOCUMENTS

| | | | | |
|---|---|---|---|---|
| 1,001,176 | A * | 8/1911 | Snee | F04B 49/24 417/334 |
| 2,257,660 | A * | 9/1941 | Tilsy | F03D 9/28 417/16 |
| 3,901,440 | A | 8/1975 | Baker | |
| 4,021,144 | A | 5/1977 | Matsusaka | |
| 5,222,553 | A | 6/1993 | Temple | |
| D372,719 | S | 8/1996 | Jensen | |
| 6,017,198 | A | 1/2000 | Traylor | |
| 6,095,759 | A | 8/2000 | Breslin | |
| 8,956,532 | B1 | 2/2015 | James, Jr. | |

* cited by examiner

*Primary Examiner* — D. Andrews
*Assistant Examiner* — Ronald R Runyan

(57) ABSTRACT

The pump-activated manual water well comprises a valve, a gate structure, a pulley structure, a cord, and a well. The gate structure, the pulley structure, and the cord attach to the valve. The valve installs in the well. The well is a mechanical structure that pumps underground water, commonly called ground water, to the surface of the ground. The gate structure, the pulley structure, and the cord control the flow of water through the well by controlling the flow of water through the valve.

11 Claims, 5 Drawing Sheets

PUMP-ACTIVATED MANUAL WATER WELL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of construction, wells, and well-heads, more specifically, a casing or tubing in a wellhead. (E21B33/04)

SUMMARY OF INVENTION

The pump-activated manual water well comprises a valve, a gate structure, a pulley structure, a cord, and a well. The gate structure, the pulley structure, and the cord attach to the valve. The valve installs in the well. The well is a mechanical structure that pumps underground water, commonly called ground water, to the surface of the ground. The gate structure, the pulley structure, and the cord control the flow of water through the well by controlling the flow of water through the valve.

These together with additional objects, features and advantages of the pump-activated manual water well will be readily apparent to those of ordinary skill in the art upon reading the following detailed description of the presently preferred, but nonetheless illustrative, embodiments when taken in conjunction with the accompanying drawings.

In this respect, before explaining the current embodiments of the pump-activated manual water well in detail, it is to be understood that the pump-activated manual water well is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pump-activated manual water well.

It is therefore important that the claims be regarded as including such equivalent construction insofar as they do not depart from the spirit and scope of the pump-activated manual water well. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
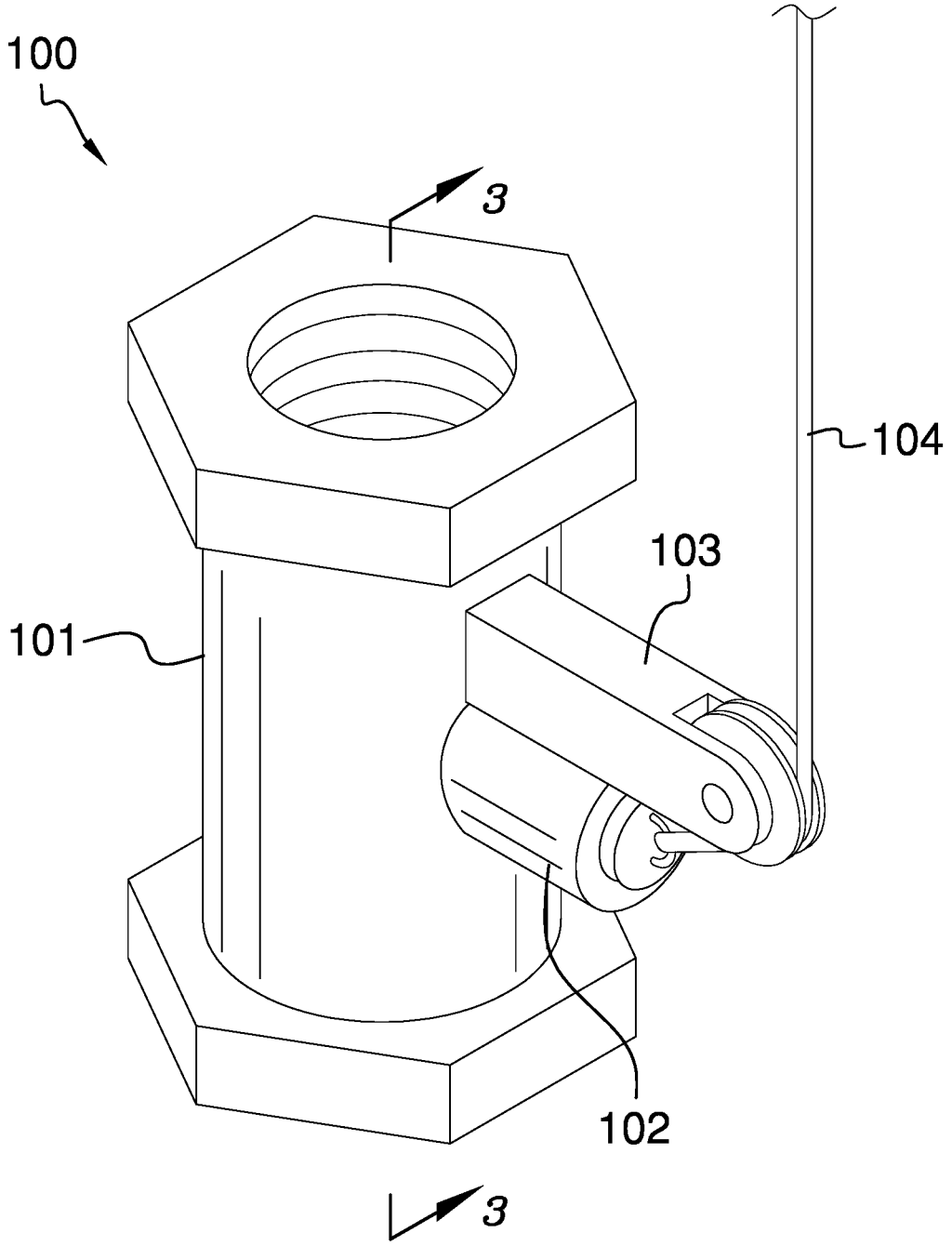
FIG. 1 is a perspective view of an embodiment of the disclosure.
Figure 2:
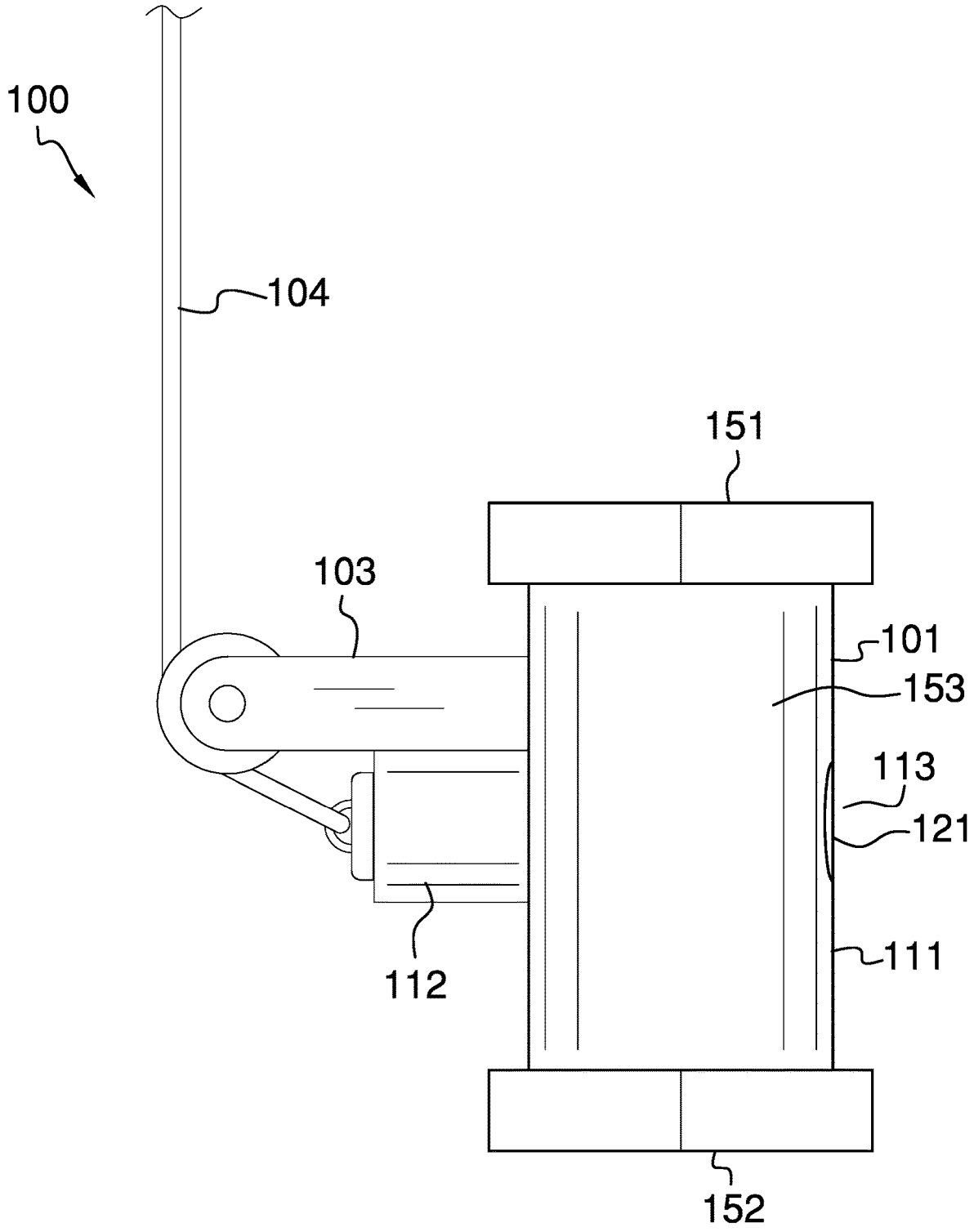
FIG. 2 is a side view of an embodiment of the disclosure.
Figure 3:
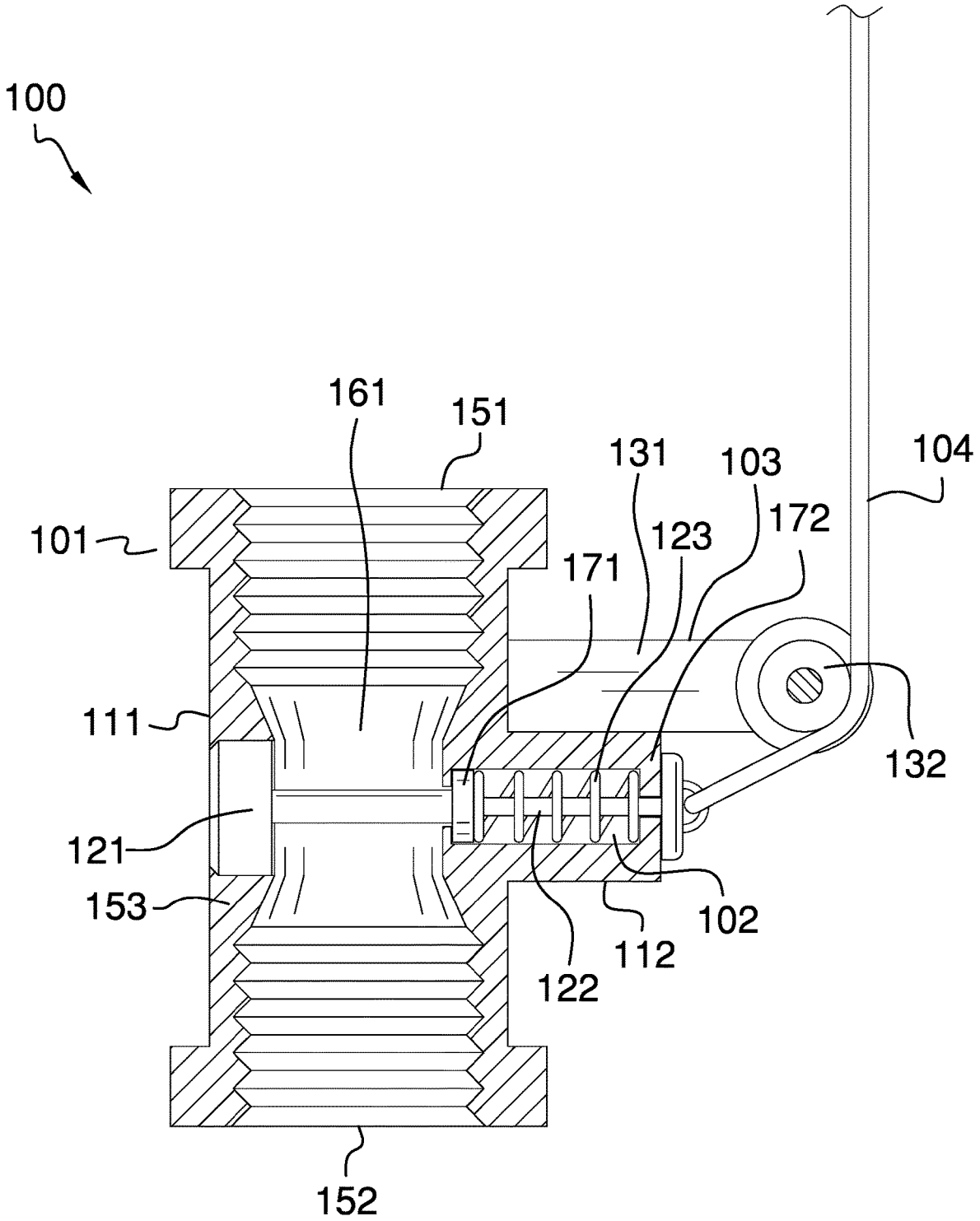
FIG. 3 is a cross-sectional view of an embodiment of the disclosure across 3-3 as shown in FIG. 1.
Figure 4:
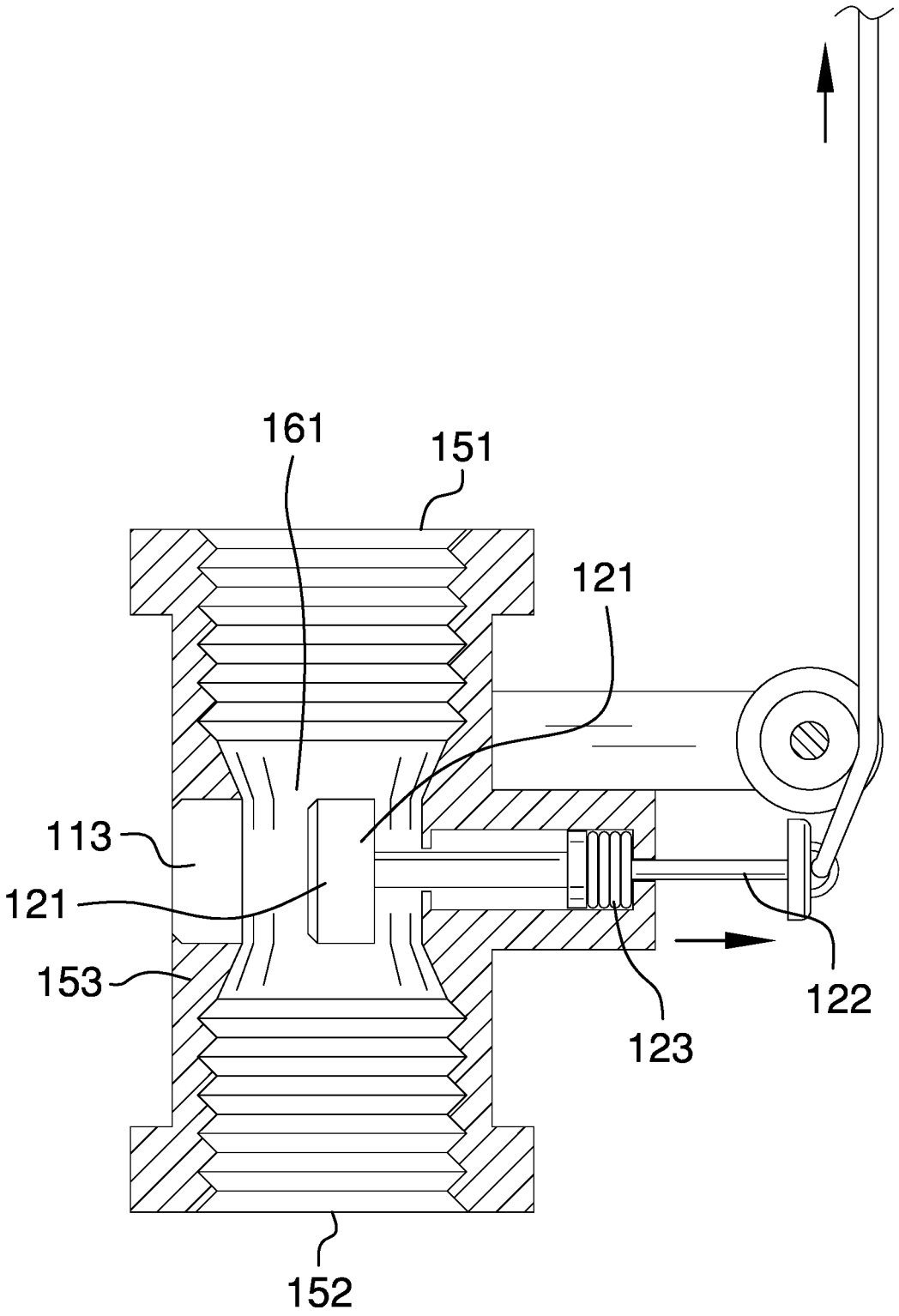
FIG. 4 is a cross-sectional view of an embodiment of the disclosure.
Figure 5:
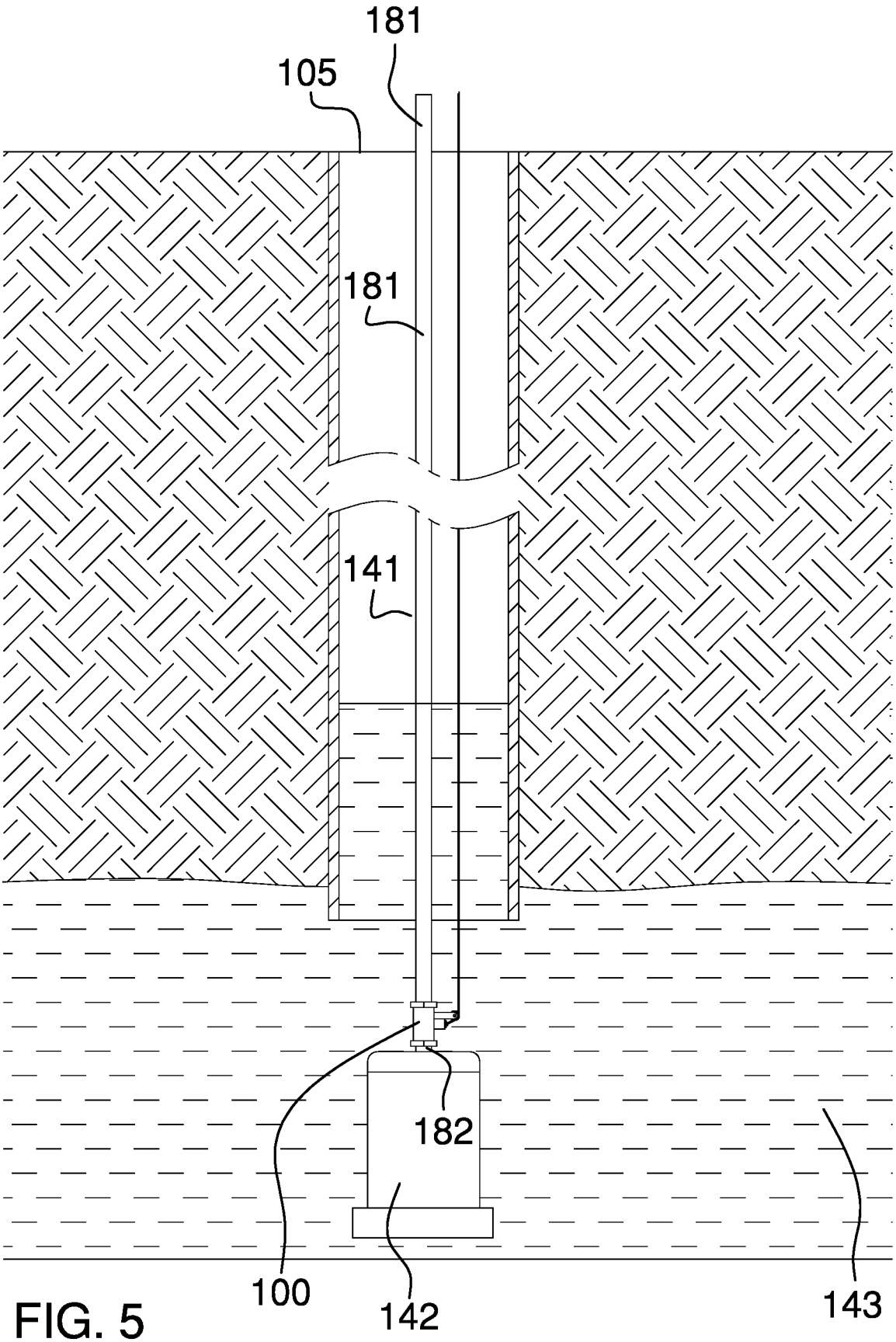
FIG. 5 is an in-use view of an embodiment of the disclosure.

Detailed reference will now be made to one or more potential embodiments of the disclosure, which are illustrated in FIGS. 1 through 5.

The pump-activated manual water well 100 (hereinafter invention) is a valve 101 used to control a well 105. The invention 100 comprises a valve 101, a gate structure 102 structure, a pulley 132 structure 103, a cord 104, and a well 105. The gate structure 102, the pulley 132 structure 103, and the cord 104 attach to the valve 101. The valve 101 installs in the well 105. The well 105 is a mechanical structure that pumps underground water, commonly called ground water 143, to the surface of the ground. The gate structure 102 structure, the pulley 132 structure 103, and the cord 104 control the flow of ground water 143 through the well 105 by controlling the flow of ground water 143 through the valve 101.

The well 105 is a construction that is formed in the ground. The well 105 provides access to ground water 143 contained in the natural underground reservoir such that the ground water 143 is accessible from above the ground. The well 105 comprises a well 105 shaft 141, a well 105 pump 142, and a ground water 143.

The well 105 shaft 141 is a hole that is formed the ground. The well 105 shaft 141 forms the path through which the ground water 143 is pumped from the underground natural reservoir to the surface of the ground. The well 105 shaft 141 further comprises a superior well 105 pipe 181 and an inferior well 105 pipe 182. The superior well 105 pipe 181 is a pipe. The superior well 105 pipe 181 transports the ground water 143 from the valve 101 to the surface of the ground. The inferior well 105 pipe 182 is a pipe. The inferior well 105 pipe 182 transports the ground water 143 from the natural underground reservoir to the valve 101.

The well 105 pump 142 is a mechanical device that generates a pressure differential which is used for transporting the ground water 143 from the underground natural reservoir to the surface of the ground. The pump is defined elsewhere in this disclosure.

The valve 101 is a mechanical structure. The valve 101 inserts into the flow path formed by the well 105 shaft 141 of the well 105. The valve 101 controls the flow of ground water 143 through the well 105 shaft 141 of the well 105. The use of a valve 101 to control the flow of a fluid is well 105 known and documented in the mechanical arts. The valve 101 is defined elsewhere in this disclosure. The valve 101 comprises a master pipe 111, a gate housing 112, and a drain port 113. The valve 101 further comprises a first end 151, a second end 152, and a lateral face 153.

The first end 151 is the open congruent end of the pipe structure of the valve 101 that attaches to the superior well 105 pipe 181 of the well 105 using a threaded connection. The second end 152 is the open congruent end of the pipe structure of the valve 101 that attaches to the inferior well 105 pipe 182 of the well 105 using a threaded connection. The lateral face 153 forms the surfaces of the valve 101 that contains the ground water 143 as it flows from the inferior well 105 pipe 182 to the superior well 105 pipe 181.

The master pipe 111 is a pipe. The master pipe 111 is a prism-shaped structure. The master pipe 111 transports ground water 143 from the inferior well 105 pipe 182 of the well 105 shaft 141 to the superior well 105 pipe 181 of the well 105 shaft 141. The master pipe 111 further comprises a master passage 161. The master passage 161 is a prism-shaped negative space formed through the master pipe 111 of the valve 101. The master passage 161 forms a channel that transports the ground water 143 through the valve 101.

The drain port 113 is an aperture that is formed through the lateral face of the prism structure of the master pipe. The drain port 113 is opened and closed using the gate housing 112. The opening of the drain port 113 drains the water contained within the master pipe 111. By draining the master pipe 111, the master pipe 111 can be subsequently removed from the well shaft 141 without having to also remove the water contained in the master pipe 111.

The gate housing 112 is a rigid structure. The gate housing 112 attaches to the lateral face 153 of the prism structure of the master pipe 111. The position of the gate housing 112 is diametrically opposed to the drain port 113. The gate housing 112 is a rigid casing that contains the gate structure 102. The gate housing 112 is formed with all apertures and form factors necessary to accommodate the operation of the gate structure 102. The gate housing 112 comprises a gate slot 171 and a gate chamber 172.

The gate structure 102 is a mechanical structure. The gate structure 102 installs in the valve 101. The gate structure 102 physically controls the flow of ground water 143 through the drain port 113 by opening and closing the drain port 113. The gate structure 102 forms a barrier capable of sealing the drain port 113. The gate structure 102 comprises a control plate 121, a shaft 122, and a spring 123.

The control plate 121 is a disk-shaped structure. The control plate 121 inserts into the drain port 113 to control the flow of ground water 143 through the drain port 113. The control plate 121 is geometrically similar to the drain port 113 of the master pipe 111 such that the control plate 121 blocks the flow of ground water 143 through drain port 113 when the control plate 121 inserts into the drain port 113 of the master pipe 111.

The gate slot 171 is a negative space formed through the lateral face 153 of the master pipe 111. The shaft 122 inserts into and is removed from the master pipe 111 through the gate slot 171. The gate chamber 172 is a shell structure that forms a hollow contained space for the gate structure 102. The gate chamber 172 is formed with all apertures and form factors necessary to accommodate the operation of the gate structure 102.

The shaft 122 is a prism-shaped structure. The shaft 122 attaches to the control plate 121. The shaft 122 forms an anchor point to which the cord 104 attaches such that the cord 104 withdraws the control plate 121 from the drain port 113 of the master pipe 111.

The spring 123 is an energy storage device. The spring 123 installs in the gate housing 112 such that the spring 123 deforms when the control plate 121 is withdrawn from the drain port 113 of the master pipe 111 by the cord 104. When the cord 104 is relaxed, the energy stored in the spring 123 releases such that the spring 123 will provide the motive forces required to reinsert the control plate 121 into the drain port 113 of the master pipe 111. The spring 123 is in its relaxed shape when the control plate 121 is fully inserted into the drain port 113 of the master pipe 111.

The pulley 132 structure 103 is a mechanical structure. The pulley 132 structure 103 is a rotating structure. The pulley 132 structure 103 controls the direction of the path of the cord 104 into the gate structure 102. The pulley 132 structure 103 comprises a pulley 132 jib 131 and a pulley 132.

The pulley 132 jib 131 is a mechanical structure. The pulley 132 jib 131 attaches to the exterior of the gate chamber 172 of the gate housing 112. The pulley 132 jib 131 attaches to the exterior of the gate housing 112 in the manner of a cantilever. The pulley 132 jib 131 attaches the pulley 132 to the gate housing 112.

The pulley 132 is a rotating structure. The cord 104 is threaded through the pulley 132 such that the cord 104 will attach to the shaft 122 of the gate structure 102. The use of a pulley 132 is well 105—known and documented in the mechanical arts. The pulley 132 is defined elsewhere in this disclosure.

The cord 104 is a linear device. The cord 104 is a flexible device. The cord 104 has tensile strength. The cord 104 does not have compressive strength. A first attachment point of the cord 104 attaches to the gate structure 102. A second attachment point of the cord 104 is threaded through the well 105 shaft 141 of the well 105 such that a tensile force can be applied to the gate structure 102 by pulling on the cord 104. The cord 104 is defined elsewhere in this disclosure.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Channel: As used in this disclosure, a channel is a tubular passage through which an object or fluid is passed through.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Compression Spring: As used in this disclosure, a compression spring is a spring that resists forces attempting to compress the spring in the direction of the center axis of the spring. The compression spring will return to its original position when the compressive force is removed.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Correspond: As used in this disclosure, the term correspond is used as a comparison between two or more objects wherein one or more properties shared by the two or more objects match, agree, or align within acceptable manufacturing tolerances.

Cross-section: As used in this disclosure, a cross-section is a surface or shape that would be exposed by making a straight cut through an object.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter. Include Radial Diametrically Opposed: As used in this disclosure, diametrically opposed is a term that describes the locations of a first object and a second object located at opposite ends of a diameter drawn through a third object. The term diametric opposition can also be used to describe this relationship.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Ground: As used in this disclosure, the ground is a solid supporting surface formed by the Earth. The term level ground means that the supporting surface formed by the ground is roughly perpendicular to the force of gravity.

Helical Spring: As used in this disclosure, a helical spring is a compression spring shaped in the form of a cylindrical helix.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid structure that encloses and protects one or more devices.

Inferior: As used in this disclosure, the term inferior refers to a directional reference that is parallel to and in the same direction as the force of gravity when an object is positioned or used normally.

Jib: As used in this disclosure, a jib is a beam structure that: 1) is mounted with a free end in the manner of a cantilever; and, 2) suspends a load at the free end of the jib. In multicomponent beam structures, such as with a crane, the jib is the sub-structure that physically suspends the load.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Pipe: As used in this disclosure, a pipe is a hollow prism-shaped device that is suitable for use in transporting a fluid. The line that connects the center of the first base of the prism to the center of the second base of the prism is referred to as the axis of the prism or the centerline of the pipe. When two pipes share the same centerline they are said to be aligned. In this disclosure, the terms inner dimension of a pipe and outer dimension are used as they would be used by those skilled in the plumbing arts.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board or a plank.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pulley: As used in this disclosure a pulley is a wheel with a grooved rim around which a cord (or other form of rope, line, or cable) passes. The pulley is used to change the direction of a force applied to the cord.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Radial: As used in this disclosure, the term radial refers to a direction that: 1) is perpendicular to an identified central axis; or, 2) projects away from a center point.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force.

Shaft: As used in this disclosure, a shaft is a long, narrow and rigid prism structure that is used as: 1) a structural element of a larger object; or 2) as a grip or lever for a handle. Shafts often have a cylindrical shape.

Shaft: As also used in this disclosure, a shaft is a long, narrow, and vertical hole is formed in the ground.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Valve: As used in this disclosure, a valve is a device that is used to control the flow of a fluid (gas or liquid) through a pipe, tube, or hose.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A manually controlled water well comprising a valve, a gate structure, a pulley structure, a cord, and a well;

wherein the gate structure, the pulley structure, and the cord attach to the valve;

wherein the valve installs in the well;

wherein the well is a mechanical structure that enables ground water to the surface of the ground;

wherein the gate structure, the pulley structure, and the cord control the flow of ground water through the well by controlling the flow of ground water through the valve;

wherein the gate structure installs in the valve;

wherein the gate structure physically controls the flow of ground water through a well shaft of the well;

wherein a gate housing is a rigid structure;

wherein the gate housing attaches to the lateral face of a master pipe;

wherein the gate housing is a rigid casing that contains the gate structure;

wherein the pulley structure is a mechanical structure;

wherein the pulley structure is a rotating structure;

wherein the pulley structure controls the direction of the path of the cord into the gate structure;

wherein the cord is a linear device;

wherein the cord is a flexible device;

wherein the cord has tensile strength;

wherein the cord does not have compressive strength;

wherein a first attachment point of the cord attaches to the gate structure;

wherein a second attachment point of the cord is threaded through the well shaft of the well;

wherein the well comprises the well shaft, a well pump, and a ground water;

wherein the well shaft is a hole that is formed the ground;

wherein the well shaft forms the path through which the ground water is pumped from an underground natural reservoir to the surface of the ground;

wherein the well pump is a mechanical device that generates a pressure differential which is used for transporting the ground water from the underground natural reservoir to the surface of the ground;

wherein the valve is a mechanical structure;

wherein the valve inserts into the flow path formed by the well shaft of the well;

wherein the valve controls the flow of ground water through the well shaft of the well;

wherein the master pipe transports ground water from an inferior well pipe of the well shaft to a superior well pipe of the well shaft;

wherein the valve comprises the master pipe, the gate housing, and a drain port;

wherein the gate housing attaches to the master pipe;

wherein the valve further comprises a first end, a second end, and a lateral face;

wherein the first end is the open congruent end of the pipe structure of the valve that attaches to the superior well pipe of the well using a threaded connection;

wherein the second end is the open congruent end of the pipe structure of the valve that attaches to the inferior well pipe of the well using a threaded connection;

wherein the lateral face forms the surfaces of the valve that contains the ground water as it flows from the inferior well pipe to the superior well pipe;

wherein the drain port is an aperture formed through the lateral face of the master pipe.

2. The manually controlled water well according to claim 1 wherein the gate structure comprises a control plate, a shaft, and a spring;

wherein the control plate is geometrically similar to the drain port;

wherein the shaft attaches to the control plate;

wherein the spring is an energy storage device;

wherein the spring installs in the gate housing such that the spring deforms when the control plate is withdrawn from the drain port of the master pipe by the cord.

3. The manually controlled water well according to claim 2 wherein the well shaft further comprises the superior well pipe and the inferior well pipe;

wherein the superior well pipe is a pipe;

wherein the superior well pipe transports the ground water from the valve to the surface of the ground;

wherein the inferior well pipe is a pipe;

wherein the inferior well pipe transports the ground water from the natural underground reservoir to the valve.

4. The manually controlled water well according to claim 3 wherein the master pipe is a pipe;

wherein the master pipe has a tubular structure.

5. The manually controlled water well according to claim 4 wherein the master pipe further comprises a master passage;

wherein the master passage is a negative space formed through the master pipe of the valve;

wherein the master passage forms a channel that transports the ground water through the valve.

6. The manually controlled water well according to claim 5 wherein the control plate inserts into drain port to control the flow of ground water through the master passage;

wherein the control plate blocks the flow of ground water the master passage when the control plate inserts into the drain port of the master pipe.

7. The manually controlled water well according to claim 6 wherein the shaft forms an anchor point to which the cord attaches such that the cord withdraws the control plate from the drain port of the master pipe;

wherein when the cord is relaxed, the energy stored in the spring releases such that the spring will provide the motive forces required to reinsert the control plate into the drain port of the master pipe;

wherein the spring is in its relaxed shape when the control plate is fully inserted into the drain port of the master pipe.

8. The manually controlled water well according to claim 7 wherein the gate housing comprises a gate slot and a gate chamber;

wherein the gate slot is a negative space formed through the lateral face of the master pipe;

wherein the control plate inserts into and is removed from the master pipe through the gate slot;

wherein the gate chamber is a shell structure that forms a hollow contained space for the gate structure;

wherein the gate chamber is formed with all apertures and form factors necessary to accommodate the operation of the gate structure.

9. The manually controlled water well according to claim 8 wherein the pulley structure comprises a pulley jib and a pulley;

wherein the pulley jib attaches the pulley to the gate housing.

10. The manually controlled water well according to claim 9 wherein the pulley jib is a mechanical structure;

wherein the pulley jib attaches to the exterior of the gate chamber of the gate housing;

wherein the pulley jib attaches to the exterior of the gate housing in the manner of a cantilever.

11. The manually controlled water well according to claim 10 wherein the pulley is a rotating structure;

wherein the cord is threaded through the pulley such that the cord will attach to the shaft of the gate structure.

* * * * *